United States Patent [19]

Martin

[11] 4,439,677

[45] Mar. 27, 1984

[54] WELLBORE FRACTURE TRACING

[75] Inventor: F. Glenn Martin, Irving, Tex.

[73] Assignee: Atlantic Richfield Company, Los Angeles, Calif.

[21] Appl. No.: 318,511

[22] Filed: Nov. 5, 1981

[51] Int. Cl.[3] ..... G01V 5/04

[52] U.S. Cl. ..... 250/260

[58] Field of Search ..... 250/259, 260

[56] References Cited

U.S. PATENT DOCUMENTS

| | | | |
|---|---|---|---|
| 2,358,945 | 9/1944 | Teichmann | 250/260 |
| 2,588,210 | 3/1952 | Crisman et al. | 250/260 |
| 3,503,447 | 3/1970 | Hamby, Jr. | 250/260 |
| 3,940,612 | 2/1976 | Sparlin et al. | 250/260 |

*Primary Examiner*—Craig E. Church
*Assistant Examiner*—Carolyn E. Fields
*Attorney, Agent, or Firm*—Roderick W. MacDonald

[57] ABSTRACT

A method for determining the vertical extent of a fracture in a wellbore wall wherein a fluid loss control composition is employed which contains at least at one filter cake forming material which has been radioactively tagged so that upon injection of the fluid control composition into the wellbore in the vicinity of the fracture, the filter cake is built up along the fracture and thereafter, upon running a nuclear log survey in the wellbore to determine the vertical extent of the filter cake, the vertical extent of the fracture is also thereby determined.

4 Claims, 4 Drawing Figures

WELLBORE FRACTURE TRACING

BACKGROUND OF THE INVENTION

Heretofore, radioactive liquid solutions of iodine 131 had been employed in a wellbore followed by an overflush of a non-radioactive liquid to get the radioactive liquid out of the wellbore before nuclear logging. Thereafter, a nuclear log survey was run to determine where the liquid went when it left the wellbore and entered the surrounding formation. A problem with liquid radioactive tracer surveys has been that if the overflush is too large, the radioactive liquid can be washed so far away from the wellbore that the nuclear log survey cannot detect the liquid, i.e., the liquid is flushed beyond the range of the logging tool.

Also, heretofore, propping agents used in fracturing treatments have been radioactively tagged to determine where the propping agent went. Unfortunately, for finding the vertical extent of a fracture in a wellbore, radioactively tagged propping agents are not useful because they, being large, relatively heavy particles, tend to settle towards the lower end of the fracture. For example, in a fracture of a hundred foot height, the propping agent could settle in the lower twenty-five feet. Thus, a propping agent survey is not reliable in determining the vertical height of a fracture.

It is important and quite helpful to know the vertical extent of a fracture because, when designing a well treatment to be employed, knowledge of the vertical extent of the fracture will help determine the volume of fluid used in the subsequent well treatment. For example, if it is not known that a fracture extends for a hundred feet vertically, and it is assumed that the fracture is much smaller in height, such as fifty feet, the volume of fluid injected for subsequent treatments when designed for a fifty foot fracture will be woefully inadequate for the existing one hundred foot fracture and the subsequent well treatment quite ineffective, if effective at all.

Heretofore, temperature surveys have been employed to help determine the vertical extent of a fracture in a wellbore. These surveys inject a liquid which is at a substantially different temperature from the temperature of the fluids in the wellbore and then a temperature logging tool is run in the wellbore to locate temperature anomalies caused by fractures. However, unfortunately, temperature surveys are subject to many influences such as washed out areas in the wellbore, different pipe diameters and wall thicknesses, and the like, which make accurate interpretation of temperature surveys difficult. Also, temperature anomalies are transient and will disappear if the survey is not run promptly and prior to any fluid movement in the wellbore.

Accordingly, it is highly desirable to have another tool available to help determine the vertical extent of a fracture in a wellbore so that subsequent treatments of the well can be tailored to accomodate that fracture in an effective manner.

SUMMARY OF THE INVENTION

In accordance with this invention, a fluid loss control composition which carries one or more materials designed to form a filter cake on the wellbore wall in an area of permeability in that wellbore wall in a conventional manner is employed. However, in this invention, at least one of the filter cake forming materials is deliberately radioactively tagged. Thereafter, the fluid loss control composition is injected by way of a fluid into the wellbore and will preferentially flow into the fracture. Small areas of permeability in and near the fracture along its vertical extent will attract the fluid loss composition and a filter cake will build up on those areas as a result. Thereafter, a nuclear (radioactive) log survey is run in the wellbore to detect these various filter cake buildups along the vertical height of the wellbore thereby producing a logging profile which is indicative of the vertical extent of the fracture.

Accordingly, it is an object of this invention to provide a new and improved method for determining the vertical extent of fractures in a wellbore. It is another object to provide a new and improved well survey method. Other aspects, objects and advantages of this invention will be apparent to those skilled in the art from this disclosure and the appended claims.

DETAILED DESCRIPTION OF THE INVENTION

Figure 1:
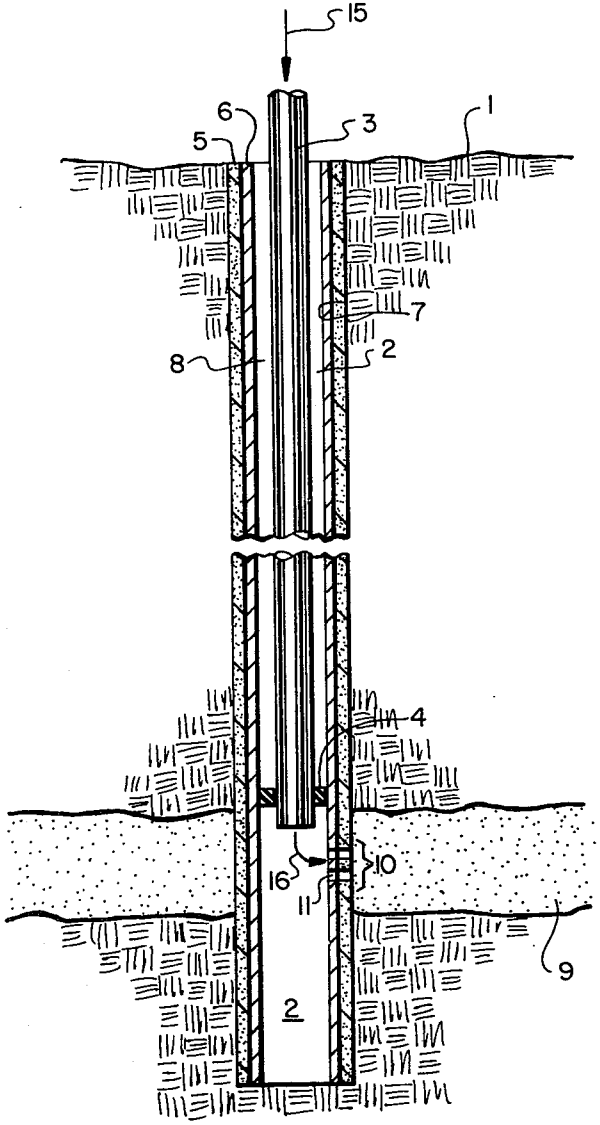
FIG. 1 shows a vertical cross-section of a wellbore in the earth in which the method of this invention can be practiced.

FIG. 1 shows the earth's surface 1 with wellbore 2 extending downwardly therein and through oil-bearing geologic formation 9. Wellbore 1 contains production tubing 3 which is connected to various conventional production apparatus (not shown) at surface 1. Wellbore wall 7 is lined with cement 5 which in turn is lined with steel casing 6. Tubing 3 has a pack off 4 set between the outer wall of tubing 3 and inner wall of casing 6 to isolate annulus 8 above formation 9. Formation 9 has a vertically extending fracture therein for the distance encompassed by bracket 10. Casing 6 and cement 5 have a plurality of perforations 11 therein for communication between the interior of tubing 3 and fracture 10.

Thus, when a fluid is injected into wellbore 2 by way of tubing 3, as shown by arrow 15, the fluid passes downwardly inside tubing 3, and out into perforations 11 and fracture 10, as shown by arrow 16.

Figure 2:
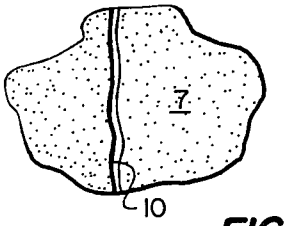
FIG. 2 is a vertical view of the section of the wellbore wall with a fracture running essentially vertically therethrough.

FIG. 2 shows a portion of wellbore wall 7 which contains fracture 10. This is what the fluid ideally sees when it passes through perforations 11 into formation 9.

Figure 3:
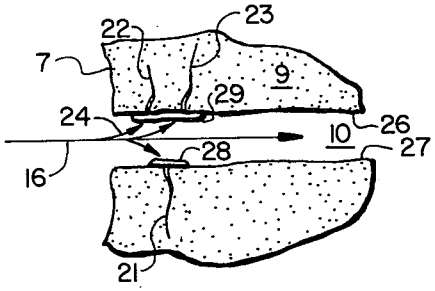
FIG. 3 is an enlarged horizontal section looking downwardly through the fracture.

FIG. 3 shows fracture 10 from a view inside formation 9 looking downwardly through fracture 10 and viewing fluid 16 passing into that fracture. Formation 9 has permeability by way of pores therein which permeability is represented in simplified form in FIG. 3 by lines, 21, 22, and 23. Fracture 10 is so much larger in volume than pores 21 through 23, fluid 16 preferentially goes into fracture 10, but small amounts of fluid, represented by arrows 24, will leak into pores 21 through 23. If fluid 16 contains a fluid loss control composition which carries one or more materials designed to form a filter cake on a wellbore wall in an area of permeability in the wellbore wall, a filter cake will build up on inside walls 26 and 27 of fracture 10, as shown at 28 and 29, because of leakage of fluid 24 into pores 21 and 22, respectively. Thus, it can be seen that a substantial amount of filter cake can be built up along the internal vertical height of fracture 10.

Figure 4:
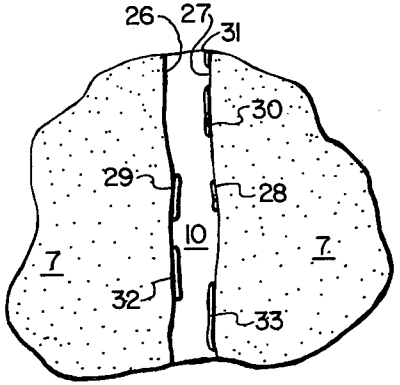
FIG. 4 is an enlarged vertical section of the wellbore wall and fracture after filter cake buildup in accordance with this invention.

This is shown in FIG. 4 which shows a section of wellbore wall 7 with fracture 10 therein and filter cakes 28 and 29 on interior wall surfaces 26 and 27 of fracture 10. Similar filter cakes 30 through 33 are built up along the vertical height of fracture 10 as represented by bracket 10 in FIG. 1.

If these filter cakes deliberately contain a radioactively tagged material, then a radioactive log survey run inside wellbore 2 and tubing 3 in a conventional manner will detect these filter cakes throughout the vertical height of fracture 10. This survey will thereby indicate the vertical extent of fracture 10 itself in formation 9.

The process of this invention can be employed after a fracture is already present in the formation or while a fracture is being generated with a conventional fracture treatment of a wellbore. Also, this invention could be practiced on a wellbore before a conventional fracture treatment to determine if there are any fractures already present in the formation that is to be subsequently fractured and, if so, the vertical extent of those already present fractures so that the subsequent fracturing treatment can be tailored to accomodate the already present fractures in the formation. The process of this invention can also be employed prior to, during, or after other well treatment processes such as acidizing or acid fracturing in the same manner as discussed hereinabove with regard to straight hydraulic fracturing.

It should be noted that with the practice of this invention there is no concern about overflushing as with prior art radioactive liquid treatments since the filter cake formed on the fracture wall is designed to stay in place, even with the substantial flow of liquid thereby. Similarly, by the practice of this invention, the radioactive material will spread out over the height of the fracture rather than settle in a lower portion of the fracture as with radioactively tagged propping agents. Also, unlike temperature surveys, the radioactive survey can be performed at a later time.

This invention can employ conventional fluid loss control compositions which are designed to form a filter cake on the wellbore wall. One or more of the materials in the fluid loss control composition are deliberately tagged with any radioactive material with a suitable half-life such as iridium 192, scandium 46, or iodine 131, in a conventional manner well known in the art, for example, as currently applied to silica propping agents.

The fluid loss control composition is then employed in a fluid such as water, oil, acid or the like and displaced into the fracture in a conventional fluid loss pumping manner. Suitable fluid loss control compositions, how they are made and displaced into a wellbore, are well known and fully disclosed in U.S. Pat. Nos. 3,163,219, 3,164,208, and 3,228,469. Therefore, further detailed discussion here it not necessary to inform those skilled in the art. In addition, U.S. Pat. No. 3,164,208 discloses fracturing processes, including the use of silica propping agent.

Any conventional nuclear log survey technique can be employed to detect the radioactive filter cake of this invention along the height of a fracture in a wellbore. Such radioactive surveys have been carried out for some time to detect radioactively tagged propping agent and radioactive liquid used by the prior art so further description of this type of survey is also not important to inform those skilled in the art. Although any material which is employed in the fluid loss control fluid and which is designed to be left in the filter cake on the wellbore wall can be radioactively tagged for the purpose of this invention, it is preferred that solid particles be so tagged. Sometimes a filter cake will be a mixture of solid particles and a polymer such as guar gum and it is preferred that the solid particles such as silica particles or calcium carbonate particles be tagged radioactively over the polymer, simply for ease of tagging, since the tagging of silica particles is already practiced for propping agents. It should be noted here that the silica particles used for propping agents are quite different from the silica, calcium carbonate, or other solid particles used in a fluid loss control composition. Propping agents are much larger than the solid particles employed in a fluid loss control composition. For example, silica propping agents are generally greater than 40 mesh (U.S. Sieve Size) whereas silica flour is often times employed in fluid loss control composition and silica flour has a substantial majority of its particles smaller than 270 mesh (U.S. Sieve Size). Thus, although the radioactive tagging of silica particles, whether they be propping agent or fluid loss control agent, is similar, radioactively tagging and displacement of propping agent into a wellbore is not similar to nor suggestive of the radioactive tagging of the much finer particles used as fluid loss control agent for use in measuring a fracture height.

EXAMPLE

A fluid loss control fluid was prepared by mixing 150 pounds of silica flour tagged in a conventional manner with 60 millicuries of iridium 192 into 77,500 gallons of gelled water fracturing fluid containing 3,875 pounds of cross-linked hydroxypropyl guar gum and 3,875 gallons of diesel oil. This fluid was displaced into a wellbore, substantially as shown in FIG. 1, during a fracturing treatment. The treatment screened out, leaving a sand bridge in the wellbore above the perforated interval which precluded any immediate logging efforts to determine fracture height with a temperature survey. After the well had produced for about six weeks, a coil tubing string was used to clear the remaining sand fill from the well bore so that the entire perforated interval was clear of obstructions. A conventional gamma ray logging tool was run in the wellbore to determine the vertical extent of the radioactive filter cake along the vertical height of the fracture. The gamma ray log showed that the treatment had produced two distinct vertical fractures with vertical heights of 50 ft. for the upper and 60 ft. for the lower. An unfractured 20 ft. shale interval was shown to separate the two fractures.

Reasonable variations and modifications are possible within the scope of this disclosure without departing from the spirit and scope of this invention.

The embodiments of the invention in which an exclusive property or privilege is claimed are defined as follows:

1. A method for determining the vertical extent of a fracture in a wellbore wall comprising providing a fluid loss control composition which carries one or more materials designed to enter into the interior of said fracture without plugging said fracture to form a filter cake on at least one interior wall inside said fracture, at least one of said filter cake forming materials being radioactively tagged, injecting said fluid loss control composition into said wellbore in the vicinity of said fracture to build up a filter cake inside said fracture along the internal vertical height of said fracture, and running a nuclear log survey in said wellbore to determine the vertical extent of said filter cake, thereby determining the vertical extent of said fracture.

2. The method according to claim 1 wherein said radioactively tagged filter cake forming material is a finely subdivided solid wherein substantially more than 50% by weight of said solid is smaller than 270 mesh.

3. The method according to claim 2 wherein said solid is at least one of silica flour and calcium carbonate flour.

4. The method according to claim 1 wherein at least one filter cake forming material is tagged with one of iridium 192, scandium 46, or iodine 131.

* * * * *